US008171906B2

(12) United States Patent
Blakeman et al.

(10) Patent No.: US 8,171,906 B2
(45) Date of Patent: May 8, 2012

(54) VALVE LIFTER GUIDE AND METHOD OF USING SAME

(75) Inventors: Rex Blakeman, Michigan Center, MI (US); Jim McLean, Grass Lake, MI (US)

(73) Assignee: APQ Development, LLC, Jackson, MI (US)

( * ) Notice: Subject to any disclaimer, the term of this patent is extended or adjusted under 35 U.S.C. 154(b) by 267 days.

(21) Appl. No.: 12/582,810

(22) Filed: Oct. 21, 2009

(65) Prior Publication Data

US 2010/0242894 A1 Sep. 30, 2010

Related U.S. Application Data

(60) Provisional application No. 61/107,125, filed on Oct. 21, 2008.

(51) Int. Cl.
*F01L 1/14* (2006.01)

(52) U.S. Cl. ..... 123/90.5; 123/90.52

(58) Field of Classification Search ..... 123/90.5, 123/90.52, 195 R; 29/888.03
See application file for complete search history.

(56) References Cited

U.S. PATENT DOCUMENTS

| | | | | |
|---|---|---|---|---|
| 3,668,945 | A | 6/1972 | Hofmann | |
| 3,886,808 | A | 6/1975 | Weber | |
| 4,173,954 | A | 11/1979 | Speckhart | |
| 4,207,775 | A | 6/1980 | Lintott | |
| 4,448,155 | A | 5/1984 | Hillebrand et al. | |
| 4,693,214 | A | 9/1987 | Titolo | |
| 4,704,995 | A | 11/1987 | Soeters, Jr. | |
| 4,765,290 | A | 8/1988 | Tanaka | |
| 5,022,356 | A | 6/1991 | Morel, Jr. et al. | |
| 5,088,455 | A | 2/1992 | Moretz | |
| 5,546,899 | A | 8/1996 | Sperling et al. | |
| 5,678,514 | A | 10/1997 | Mazzella et al. | |
| 6,257,189 | B1 | 7/2001 | Moretz et al. | |
| 6,328,009 | B1 * | 12/2001 | Brothers | 123/90.35 |
| 6,357,407 | B2 | 3/2002 | Brothers | |
| 6,405,699 | B1 | 6/2002 | Church | |
| 6,513,472 | B2 | 2/2003 | Speil et al. | |
| 6,615,784 | B2 | 9/2003 | Faria et al. | |
| 6,736,097 | B2 | 5/2004 | Riley | |
| 6,745,737 | B2 | 6/2004 | Evans et al. | |
| 6,782,858 | B2 | 8/2004 | Haas et al. | |
| 6,866,014 | B2 | 3/2005 | Spath | |
| 6,871,622 | B2 | 3/2005 | Mandal et al. | |
| 6,932,041 | B1 | 8/2005 | Riley | |
| 6,978,752 | B2 | 12/2005 | Albertson et al. | |

(Continued)

FOREIGN PATENT DOCUMENTS

GB 2062157 A 10/1979

*Primary Examiner* — Zelalem Eshete
(74) *Attorney, Agent, or Firm* — Butzel Long

(57) ABSTRACT

A valve lifter guide mountable in the engine block of an internal combustion engine, the valve lifter guide comprising at least one elongated socket defining a longitudinal axis, the at least one socket dimensioned to receive a valve lifter therein, and at least one tab projecting away from the valve lifter guide along an axis which is non-parallel to the longitudinal axis of the at least one socket. The at least one tab includes a projection thereon which is dimensioned to be received in an opening provided in the engine block. The tab further defines a surface, oriented in a plane generally perpendicular to the orientation of the projection, which is capturable between the engine block and cylinder head.

15 Claims, 5 Drawing Sheets

U.S. PATENT DOCUMENTS

| | | | |
|---|---|---|---|
| 6,994,064 | B2 | 2/2006 | Haas et al. |
| 7,007,651 | B2 | 3/2006 | Spath |
| 7,028,654 | B2 | 4/2006 | Mandal et al. |
| 7,032,562 | B1 | 4/2006 | Hoskins |
| 7,086,360 | B1 | 8/2006 | Schnell et al. |
| 7,128,034 | B2 | 10/2006 | Mandal et al. |
| 7,137,373 | B2 | 11/2006 | Seymour, II et al. |
| 7,191,745 | B2 | 3/2007 | Mandal et al. |
| 7,207,303 | B2 | 4/2007 | Geyer et al. |
| 7,210,439 | B2 | 5/2007 | Geyer et al. |
| 7,263,956 | B2 | 9/2007 | Spath et al. |
| 7,273,026 | B2 | 9/2007 | Mandal et al. |
| 7,275,507 | B2 | 10/2007 | Keller et al. |
| 7,281,329 | B2 | 10/2007 | Mandal et al. |
| 7,284,520 | B2 | 10/2007 | Mandal et al. |
| 7,350,492 | B2 | 4/2008 | Barth et al. |
| 7,373,907 | B2 | 5/2008 | Balaraman et al. |
| 7,409,940 | B2 | 8/2008 | Riley |
| 7,431,001 | B2 | 10/2008 | Keller et al. |
| 7,464,680 | B2 | 12/2008 | Geyer et al. |
| 7,565,890 | B2 | 7/2009 | Keller et al. |

* cited by examiner

VALVE LIFTER GUIDE AND METHOD OF USING SAME

CROSS-REFERENCE TO RELATED. APPLICATIONS

This application is related to, and claims the benefit of priority from, U.S. Provisional Patent Application Ser. No. 61/107,125, filed 21 Oct. 2008, the disclosure of which application is incorporated herein by reference in its entirety.

FIELD OF THE INVENTION

The invention pertains to valve lifter guides for internal combustion engines, and more specifically to such a valve lifter guide, and its method of use, which obviates the need for bolts, clips, or other conventional retainer means in order to fix the position of the valve lifter guide in the engine block.

BACKGROUND

Conventionally, internal combustion engines include a cylinder block, also commonly referred to as an engine block, containing banks of cylindrical bores for receiving the engine's reciprocating pistons. Atop the engine block there are secured one or more cylinder heads. In many conventional internal combustion engines, the cylinder head defines part of the combustion chamber, and further includes mechanical components such as one or more camshafts, spark plugs, and parts of the valve train such as the valve lifters. In other conventional internal combustion engines, the camshaft or camshafts are disposed in the engine block. In such engines, the cylinder head may include fewer or even no (e.g., a "flat head" type engine) mechanical components.

Valve lifters for internal combustion engines translate cam lobe action through a mechanical linkage to operate the intake and exhaust valves. Guide means are usually employed to properly maintain the orientation of the valve lifter as it reciprocates in response to rotary motion of the cam shaft. More specifically, orientation of valve lifters is usually accomplished by forming a flat orientation surface on the valve lifter which is oriented to the axis of the valve lifter roller and cooperates with a guide engaging the lifter orientation surface to prevent rotation of the valve lifter about its axis. Usually, two parallel flat surfaces are defined upon each lifter located upon opposite sides of the lifter axis. Exemplary of conventional valve lifters and valve lifter guides in these respects are the patents of Moretz, U.S. Pat. No. 5,088,455, and Moretz et al., U.S. Pat. No. 6,257,189, the disclosures of which are incorporated herein by reference in their entireties.

Presently, valve lifter guides are secured directly to the engine block by means of bolts, such as taught in U.S. Pat. No. 5,088,455, metal springs, retainers, or other separate fastening components. The employment of such separate components slows production time and adds to the expense of engine manufacture.

One solution to the foregoing problem is found in the disclosure of Evans et al., U.S. Pat. No. 6,745,737, which teaches an internal combustion engine with an engine block and a longitudinal extending anti-rotation guide that is affixed in a receiving groove of the engine block. The guide is constructed as an injection molded component with a one-piece, molded-on, elastically expanded or deformable clip that engages in a complementary receiving contour on the engine block.

SUMMARY

The specification discloses a valve lifter guide mountable in the engine block of an internal combustion engine. The valve lifter guide includes at least one elongated socket defining a longitudinal axis, the at least one socket dimensioned to receive a valve lifter therein, and at least one tab projecting away from the valve lifter guide along an axis which is non-parallel to the longitudinal axis of the at least one socket. The at least one tab includes a projection thereon which is dimensioned to be received in an opening provided in the engine block of an internal combustion engine. The tab further defines a surface, oriented in a plane generally perpendicular to the orientation of the projection, which is capturable between the engine block and cylinder head.

The method for installing such a valve lifter guide in the engine block of an internal combustion engine comprises the steps of providing an engine block having at least one opening for receiving a valve lifter guide, the engine block further comprising a bore positioned proximate the opening, the bore being dimensioned to receive therein the projection of said at least one valve lifter guide; inserting the projection of the at least one valve lifter guide into said bore in the engine block so that the at least one valve lifter guide is received in the said opening; and fixing a cylinder head to the engine block so that the tab of the at least one valve lifter guide is captured between the cylinder head and the engine block.

BRIEF DESCRIPTION OF THE DRAWINGS

The present invention will be appreciated from the following description and accompanying drawings, of which.

WRITTEN DESCRIPTION

Figure 1:
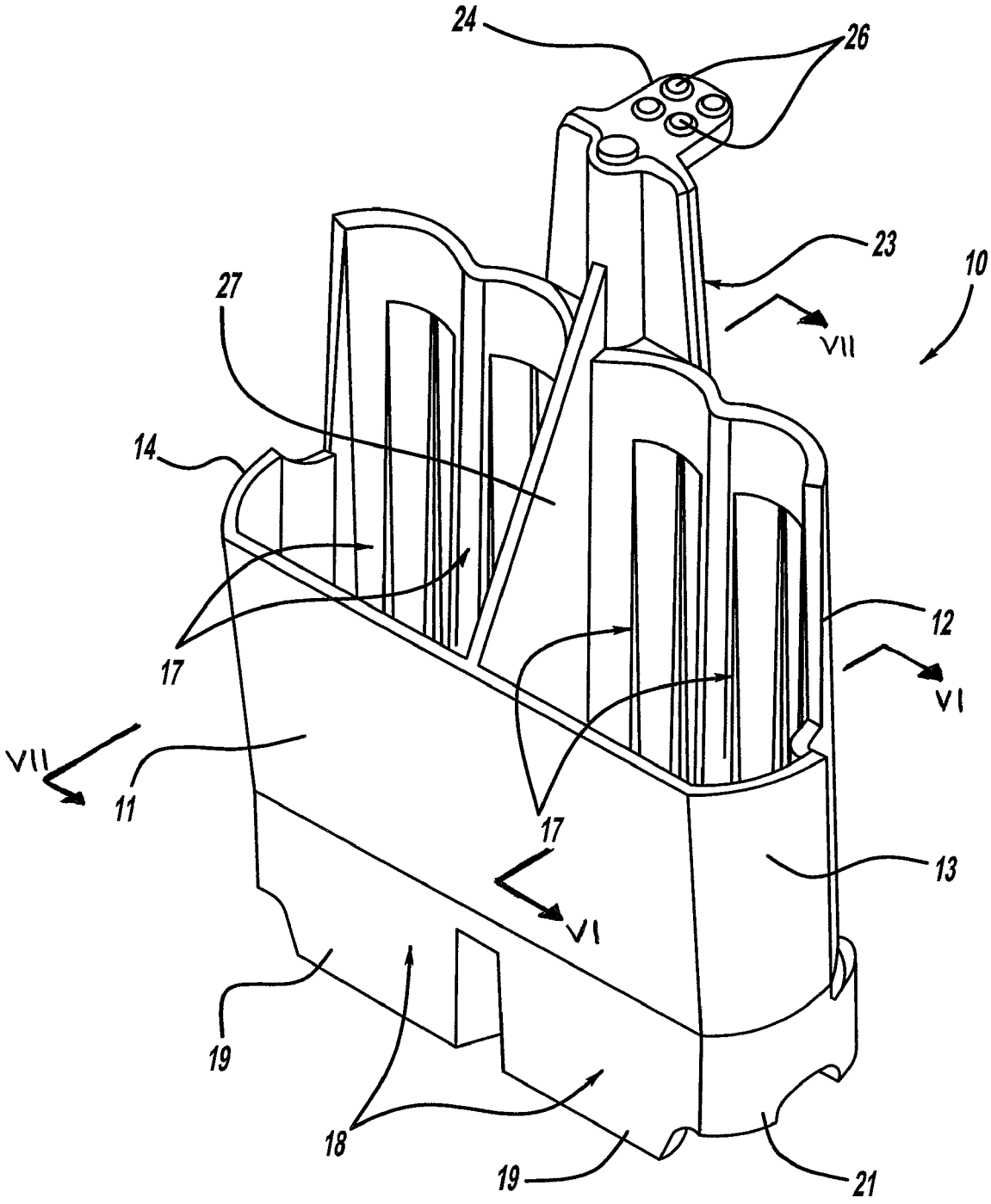
FIG. 1 is a quartering perspective of an exemplary valve lifter guide.

As required, detailed embodiments of the present invention are disclosed herein; however, it is to be understood that the disclosed embodiments are merely exemplary of the invention that may be embodied in various and alternative forms. The accompanying drawings are not necessarily to scale, and some features may be exaggerated or minimized to show details of particular components. Therefore, specific structural and functional details disclosed herein are not to be interpreted as limiting, but merely as a representative basis for teaching one skilled in the art to variously employ the present invention.

Referring then to the drawings, the valve lifter guide 10 of the exemplary embodiment is generally characterized by opposing front 11 and rear 12 walls, opposing, radiused end walls 13, 14, and a bottom surface 15 including a plurality of openings 16. Openings 16 are each dimensioned to permit passage therethrough of a single valve lifter (not shown) oriented generally coaxially with an axis extending through the center of the opening. Collectively, front 11 and rear 12 walls, end walls 13, 14, and openings 16 in bottom surface 15 define a plurality of valve lifter sockets 17 centered on each opening 16 and having a longitudinal axis coaxial with the axis extending through the center of each opening 16 and generally normal to the plane of bottom surface 15. In the illustrated embodiment, these sockets 17 are each roughly demarked by the adjacent, semi-cylindrical sections defined by the geometry of the rear wall 12 (best seen in FIGS. 1 and 2).

Further, each socket 17 is partially defined by a pair of fingers 18, each constituting an extension of one of the front 11 or rear 12 walls below the plane of bottom surface 15. Each finger 18 is cantilever supported and includes an outer free end 19 and a flat inner surface 20 which is in spaced opposed relationship to the inner surface 20 of the opposed finger. Opposed fingers 18 may be reverse tapered for clearance purposes, as later described.

Each finger 18 includes a lateral portion that defines a web 21 at the finger edge. The webs 21 generally form a plane which is transversely related to the plane of the associated finger internal surface 20, and the webs 21 reinforce the fingers against deformation in a direction transverse to the plane of the internal surfaces 20.

As noted, conventional valve lifters are characterized by a pair of spaced parallel flat surfaces defined on the outer end of the valve lifter, these flat surfaces constituting guide surfaces which cooperate with the fingers 18 of the lifter guide. The distance separating these lifter flat surfaces is preferably slightly greater than the distance separating the finger internal surfaces 19 of a common socket 17 whereby a negative clearance originally exists and a zero clearance exists between the fingers 18 and these lifter surfaces when in engagement. The opposed fingers 18 of each socket 17 are formed with a reverse taper, i.e. the distance separating the inner surfaces 19 is less proximate the terminal edges of fingers 18 than it is further away from these terminal edges. This reverse finger taper causes the fingers to engage the lifter flat surfaces only at the terminal edges with zero clearance and a slight clearance between the fingers and lifter flat surfaces further away from these terminal edges. The resiliency or spring of the fingers 18 permits a zero clearance to accurately position the lifters without producing excessive frictional resistance to movement of the lifters between the fingers.

As previously stated, the finger webs 21 reinforce the associated fingers 18 against deformation and the dimension of the webs will be predetermined to provide the desired degree of finger resiliency or stiffness resisting deformation. Each pair of opposing fingers 18 at least partially defines a socket which receives the outer end of the valve lifter upon which its flats are defined. Preferably, the lateral edge portions of the fingers are obliquely disposed to the plane of the associated fingers internal surface forming web or wing portions whereby the wing portions stiffen and strengthen the fingers against deformation in a direction transverse to the plane of the fingers internal surfaces. By varying the width or angle of the wing portions the stiffness or flexibility of the fingers can be controlled for the particular application. In this manner, the fingers are reinforced, but are still capable of slight deformation as needed to maintain the zero clearance relationship with the associated valve lifter.

During operation, the axial displacement of the valve lifters under the influence of the camshaft cam lobe (not shown) is less than the depth of the associated socket 17 such that the fingers 18 will maintain the embraced valve lifter during all phases of its movement and maintain the proper rotational orientation of the valve lifter to its associated cam lobe.

Of course, the foregoing construction of the exemplary embodiment, including the fingers 18, webs 21, and associated structure, are not necessary to practicing the invention as claimed. Accordingly, it is contemplated that the valve lifter guide may take any of a number of alternative forms, depending upon a variety of factors known to those of skill in the art. Furthermore, it will be understood by those skilled in the art that the valve lifter guide can be formed in a number of configurations as determined by the particular engine in which the guide is to be used. For instance, as most automobile engines use two valves with each cylinder, i.e. a fuel intake valve and an exhaust valve, each cylinder will have two valve lifters associated therewith requiring a pair of guides for each cylinder. As such, the lifter guide components may be formed in two unit sets.

Figure 6:
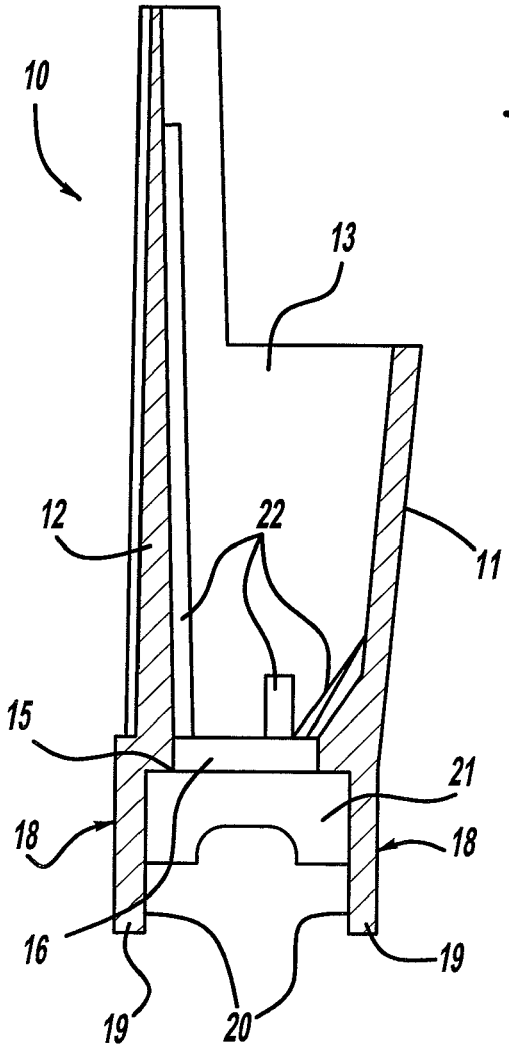
FIG. 6 is a cross-sectional view of the valve lifter guide as taken along lines 6-6 of FIG. 1.
Figure 7:
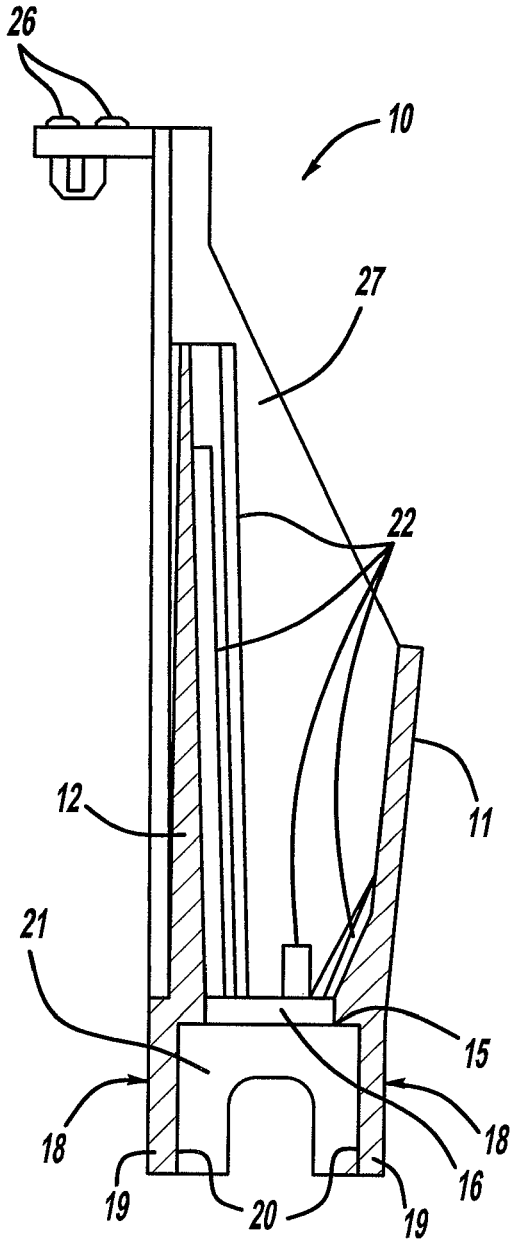
FIG. 7 is a cross-sectional view of the valve lifter guide as taken along lines 7-7 of FIG. 1.

Front 11 and rear 12 walls above the bottom surface 16 may optionally be provided with a plurality of raised guide ribs 22 (best seen in FIGS. 2, 6 and 7) extending from adjacent the openings 16 upwardly generally parallel to the longitudinal axis L. When inserting the valve lifter rods through the openings 16, the raised guide ribs 22 will tend to center a valve lifter rod (not shown) with the opening 16, thus facilitating assembly (and reducing the chance of mis-assembly) of valve lifter rods with the valve lifter.

Figure 2:
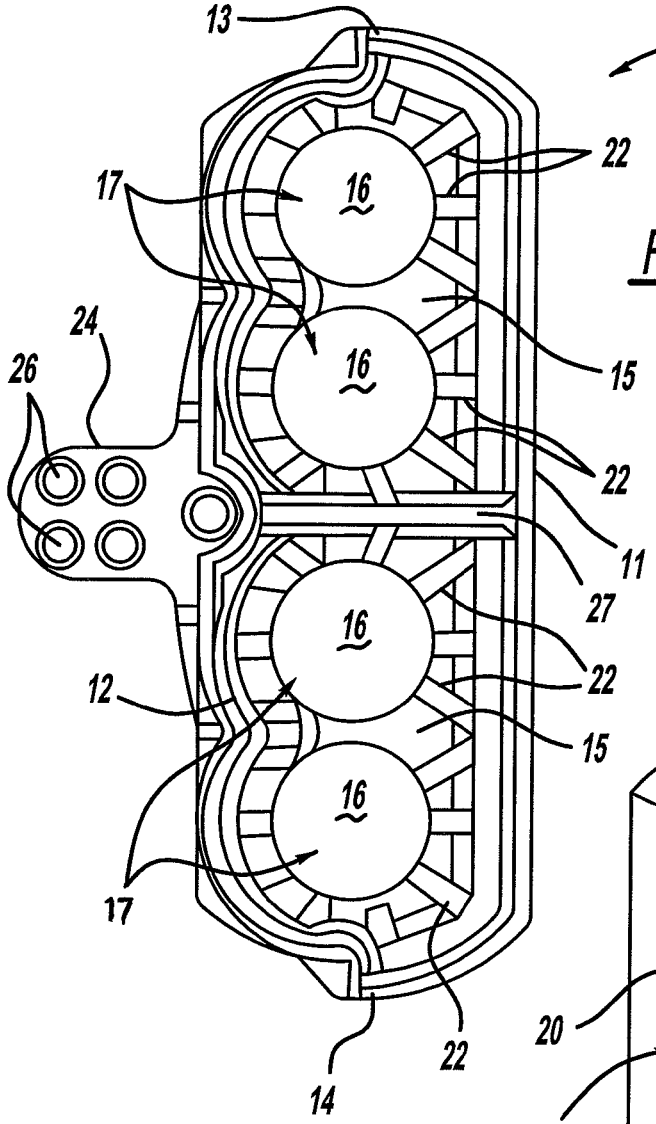
FIG. 2 is a top-down view of the valve lifter guide of FIG. 1.
Figure 3:
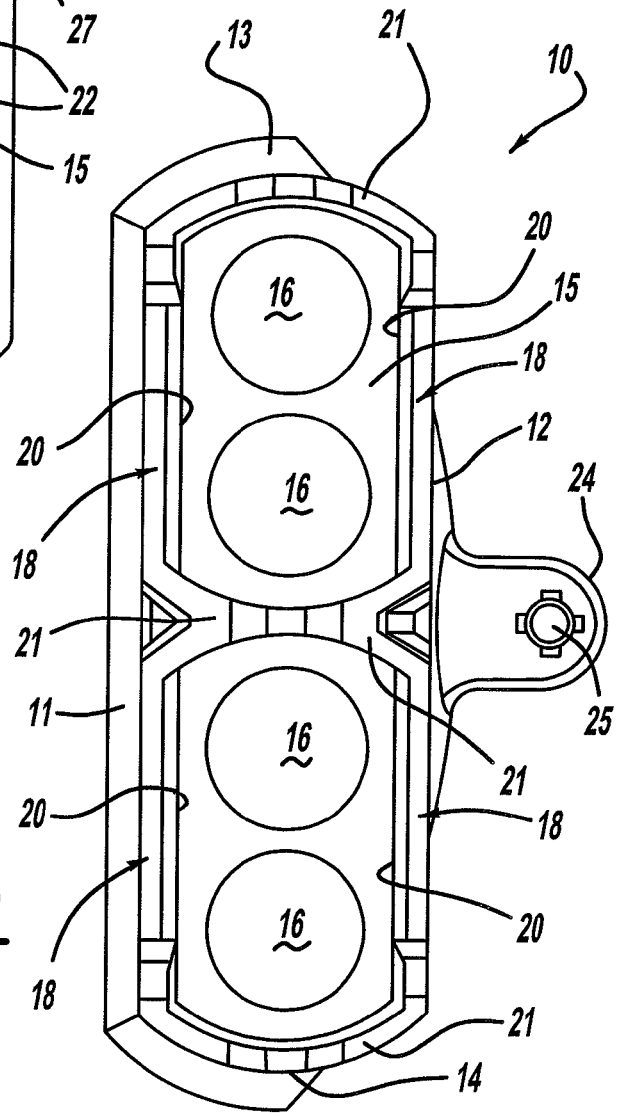
FIG. 3 is a bottom-up view of the valve lifter guide of FIG. 1.
Figure 4:
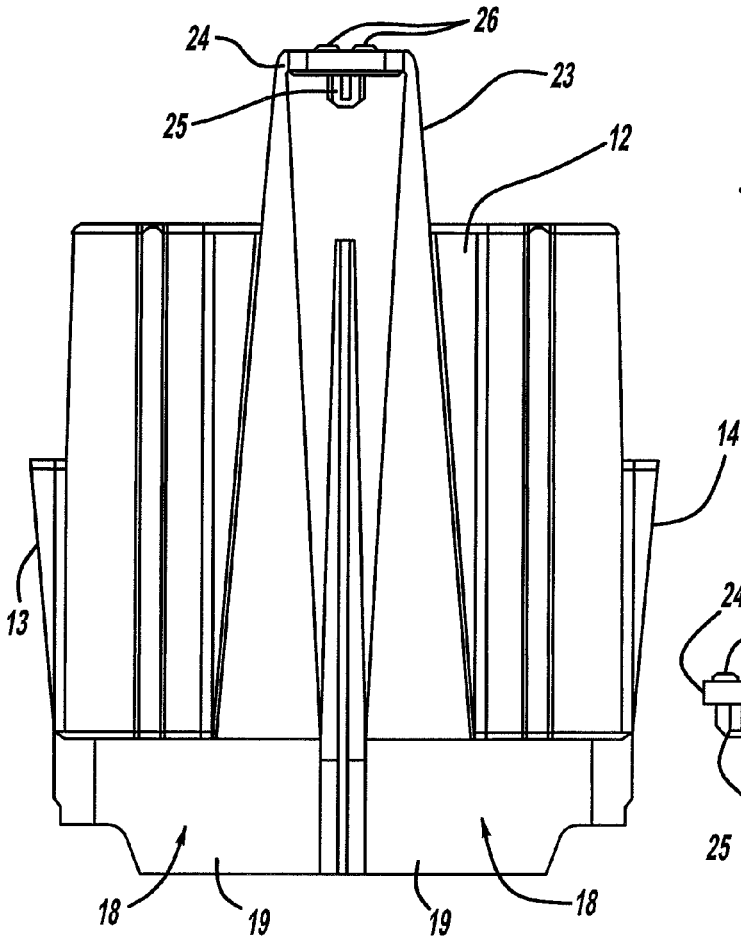
FIG. 4 is a rear view of the valve lifter guide of FIG. 1.
Figure 5:
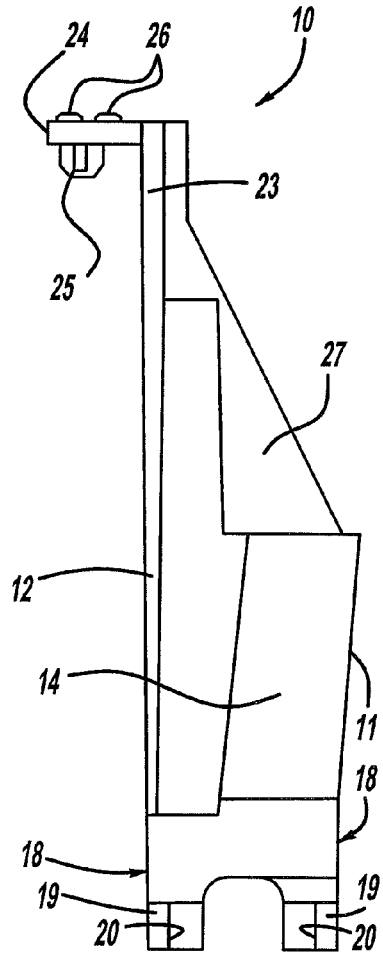
FIG. 5 is lateral view of the valve lifter guide of FIG. 1.

As shown best in FIG. 1, rear wall 12 extends upwardly to a greater extent than front wall 11. Behind rear wall 12 and formed integrally therewith there is provided a valve guide supporting member 23 that tapers in width as it extends upwardly beyond the upper edge of rear wall 12. At its terminus, a tab 24 projects away from the valve lifter guide 10 along an axis which is non-parallel to the longitudinal axis of each socket 17. In the illustrated embodiment, this axis is approximately perpendicular to the longitudinal axis of each socket 17. A projection 25 extending downwardly from the tab 24 is dimensioned to be received in an opening provided in the engine block (not shown). Tab 24 defines a generally planar surface, oriented perpendicular to the orientation of the projection 25, which is captured between the engine block and cylinder head when the valve lifter guide 10 is installed in an engine. The upper surface of tab 24 may include one or more smaller projections 26 which may be deformed under compression between the engine block and cylinder head to increase the positional securement of the guide 10.

A reinforcing wall 27 transverse to the front 11 and rear 12 walls extends between and interconnects the front 11 and rear 12 walls, the bottom surface 15. Reinforcing wall 27 tapers toward the terminus of the valve guide supporting member 23. As shown best in FIG. 2, the reinforcing wall 27 effectively separates the valve lifter guide 10 into two pairs of sockets 17 for valve lifters, one pair disposed on each side of the reinforcing wall 27.

The valve lifter guide may be manufactured, for instance by injection molding, from a synthetic plastic polyamide such as Nylon 66. This material may be reinforced with a glass-fiber filler, and may further comprise a molybdenum disulfide additive to increase the lubricity even beyond that which is inherently present in the nylon material. Such a material is commercially obtainable under the name NYLATRON GS-51 (DSM Engineering Plastics, Inc., Evansville, Ind.). The lubricity achieved by the use of the nylon reinforced material of the valve lifter guides ensures close and accurate guiding of the valve lifters even under zero clearance interfaces, and by impregnating the material with molybdenum disulfide lubricity is further enhanced. Further, by the utilization of the synthetic polymeric material superior wear characteristics are achieved between the guide and valve lifter, weight is reduced. However, it is contemplated that the valve lifter guide could also be manufactured of other materials, including, by way of example only, other polymers, ceramics, or metals.

Figure 8:
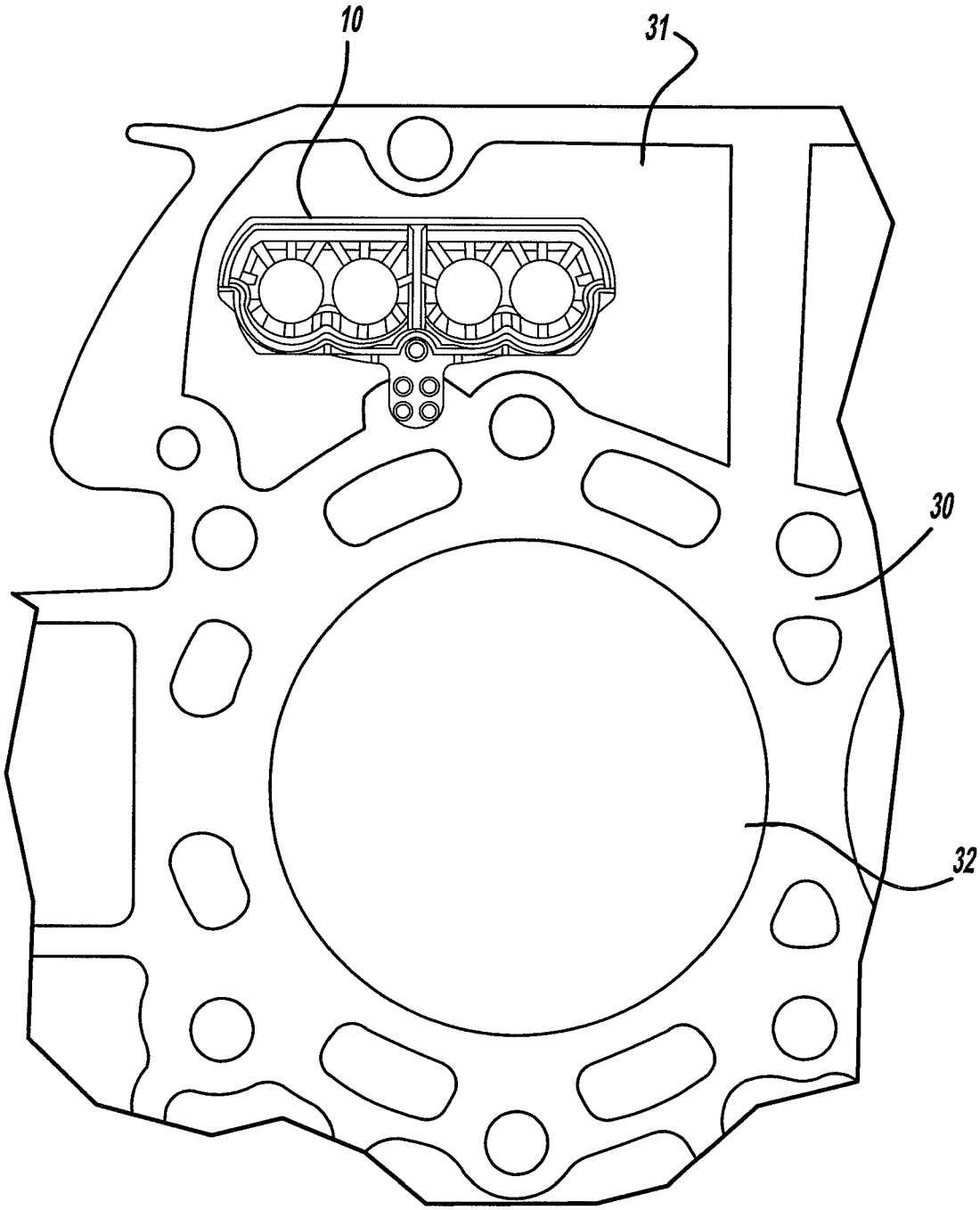
FIG. 8 is a top-down view of an exemplary valve lifter guide in position on the engine block of an internal combustion engine.

Referring now to FIG. 8, The valve lifter guide 10 is mounted upon an internal combustion engine block 30 as shown. Specifically, the engine block 30 is provided with an opening 31 proximate each piston bore 32 in which the valve lifter guide 10 is inserted. Proximate this opening 31 there is provided in the block 30 a blind bore (not visible). Projection 25 (not visible) is slidingly received in this bore 32 as the valve lifter guide 10 is lowered into the opening so that valve lifter guide 10 is suspended within the opening 31.

As each of the one or more cylinder heads (not depicted) is fixed in place on the engine block 30, the tab 24 which rests upon the surface of the engine block is captured between the bottom surface of the cylinder head and the upper surface of the engine block 30, thereby fixing the position of the valve lifter guide 10.

The foregoing description of the exemplary embodiment of the invention has been presented for purposes of illustration and description. It is not intended to be exhaustive or to limit the invention to the precise form disclosed, and modifications and variations are possible in light of the above teachings or may be acquired from practice of the innovation. The embodiments are shown and described in order to explain the principals of the innovation and its practical application to enable one skilled in the art to utilize the innovation in various embodiments and with various modifications as are suited to the particular use contemplated. Although only a few embodiments of the present innovations have been described in detail in this disclosure, those skilled in the art who review this disclosure will readily appreciate that many modifications are possible without materially departing from the novel teachings and advantages of the subject matter recited. Accordingly, all such modifications are intended to be included within the scope of the present innovations. Other substitutions, modifications, changes and omissions may be made in the design, operating conditions and arrangement of the exemplary embodiments without departing from the spirit of the present innovations.

The invention in which an exclusive property or privilege is claimed is defined as follows:

1. A method for installing a valve lifter guide in an engine block of an internal combustion engine, the method comprising the steps of:

providing a valve lifter guide having a front wall, an opposed rear wall, end walls therebetween the front wall and rear wall and a bottom surface positioned at a lower edge of the front wall, rear wall and end walls, arranged to form an elongated valve lifter socket defining a longitudinal axis, the elongated socket dimensioned to receive a valve lifter therein, and a valve guide support member extending upwardly from the rear wall and a tab projecting away from the valve guide support member along an axis which is non-parallel to the longitudinal axis of the elongated valve lifter socket, the tab including a first projection extending away from the tab and dimensioned to be received in an opening provided in the engine block of an internal combustion engine;

providing an engine block having an opening for receiving the valve lifter guide, the engine block further having a bore positioned proximate the opening, the bore being dimensioned to receive therein the first projection of the valve lifter guide;

inserting the first projection of the tab into the bore in the engine block as the valve lifter guide is received in the engine block opening so that the valve lifter guide is suspended within the engine block opening; and fixing a cylinder head to the engine block so that the tab of the valve lifter guide is captured between the cylinder head and the engine block.

2. The method of claim 1 wherein the includes a second projection extending upwardly from an upper portion of the tab support surface that is deformable under compression to retain the valve lifter guide in the engine block.

3. A valve lifter guide mountable in an engine block of an internal combustion engine, the valve lifter guide comprising:

a front wall;

an opposed rear wall;

an end wall extending therebetween the front wall and rear wall;

a bottom surface extending therebetween the front wall, rear wall and end wall, wherein the front wall, rear wall, end wall and bottom surface cooperatively form an elongated valve lifter socket;

a valve guide support member extending upwardly from the rear wall; and a tab extending from an end of the valve guide support member, and having a generally planar support surface and a first projection extending away from the tab, wherein the tab support surface is disposed between the engine block and a cylinder head, and the first projection is received in a bore in the engine block to fixedly retain the valve lifter guide in the engine block.

4. The valve lifter guide of claim 3, wherein the first projection extends downwardly from a lower surface of the tab.

5. The valve lifter guide of claim 3, wherein the first projection has a U-shape.

6. The valve lifter guide of claim 3, wherein the valve guide support member is positioned behind the rear wall and tapers in width as it extends upwardly beyond an upper edge of the rear wall.

7. The valve lifter guide of claim 3, wherein the tab includes a second projection extending upwardly from an upper portion of the tab support surface.

8. The valve lifter guide of claim 7, wherein the second projection is a raised member that is deformable under compression to retain the valve lifter guide in the engine block.

9. The valve lifter guide of claim 3, further comprising a reinforcing wall that is transverse to the front wall and rear wall and extends between and interconnects the front wall, the rear wall and the bottom surface to form a pair of elongated valve lifter sockets.

10. A valve lifter guide mountable in an engine block of an internal combustion engine, the valve lifter guide comprising:

a front wall;

an opposed rear wall;

an end wall extending therebetween the front wall and rear wall;

a bottom surface extending therebetween the front wall, rear wall and end wall, wherein the front wall, rear wall, end wall and bottom surface cooperatively form an elongated valve lifter socket;

a valve guide support member extending upwardly from the rear wall; and a tab extending from an end of the valve guide support member, and having a generally planar support surface, a first projection extending downwardly from the tab and a second projection extending upwardly from an upper portion of the tab support surface wherein the tab support surface is disposed between the engine block and a cylinder head, and the first projection is received in a bore in the engine block to fixedly retain the valve lifter guide in the engine block.

11. The valve lifter guide of claim 10, wherein the first projection has a U-shape.

12. The valve lifter guide of claim 10, wherein the valve guide support member is positioned behind the rear wall and tapers in width as it extends upwardly beyond an upper edge of the rear wall.

13. The valve lifter guide of claim 10, wherein the second projection is a raised member that is deformable under compression to retain the valve lifter guide in the engine block.

14. The valve lifter guide of claim 10, further comprising a reinforcing wall that is transverse to the front wall and rear wall and extends between and interconnects the front wall, the rear wall, and the bottom surface to form a pair of elongated valve lifter sockets.

15. The valve lifter guide of claim 10, wherein the reinforcing wall tapers towards a terminus of the valve lifter guide supporting member and separates the valve lifter guide into a air of elongated valve lifter sockets.

* * * * *